US008955260B2

(12) United States Patent
Newkirk et al.

(10) Patent No.: US 8,955,260 B2
(45) **Date of Patent: *Feb. 17, 2015**

(54) VERTICAL CABINET DOOR WITH FLUSH FRONT FACE

(71) Applicant: Hill-Rom Services, Inc. (Indiana Corporation), Batesville, IN (US)

(72) Inventors: David C. Newkirk, Lawrenceburg, IN (US); Charles L. Thomeczek, Jr., Batesville, IN (US); Joseph F. Meyer, Batesville, IN (US); Charles R. Belser, Batesville, IN (US); Colt M. Weberding, Batesville, IN (US); Dale F. Meyer, Batesville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 13 days.

This patent is subject to a terminal disclaimer.

(21) Appl. No.: 13/686,465

(22) Filed: Nov. 27, 2012

(65) Prior Publication Data

US 2013/0082582 A1 Apr. 4, 2013

Related U.S. Application Data

(63) Continuation of application No. 12/861,204, filed on Aug. 23, 2010, now Pat. No. 8,375,646.

(51) Int. Cl.
*A47F 10/00* (2006.01)
*E04C 2/52* (2006.01)
(Continued)

(52) U.S. Cl.
CPC ..... *A61G 12/00* (2013.01); *E05D 13/12* (2013.01); *E05D 13/1276* (2013.01); *E05D 15/20* (2013.01); *A47B 81/00* (2013.01); *A61G 12/005* (2013.01); *E05Y 2900/20* (2013.01)
USPC ..... 52/29; 52/36.1; 52/207; 52/220.1; 49/213

(58) Field of Classification Search
USPC ..... 52/27–29, 36.1, 36.4, 204.51, 207, 52/220.1; 312/242, 319.4; 49/125, 127, 49/128, 130, 209, 211, 213, 445; 160/201, 160/207
See application file for complete search history.

(56) References Cited

U.S. PATENT DOCUMENTS 971,751 A 10/1910 Hoyt
1,263,683 A 4/1918 Laursen
(Continued)

FOREIGN PATENT DOCUMENTS

DE 2628231 B 12/1977
EP 1947276 A1 7/2008
(Continued)

OTHER PUBLICATIONS

European Search Report; European Application No. 11178163.9-1257, Oct. 15, 2012, 6 pages.

*Primary Examiner* — Robert Canfield
*Assistant Examiner* — Charissa Ahmad
(74) *Attorney, Agent, or Firm* — Barnes & Thornburg LLP

(57) ABSTRACT

A headwall for a patient's room includes a panel having a vertically-extending front surface, an opening defined in the front surface of the headwall, and a door sized to be received in the opening. The door is vertically movable from a first position where an outer face of the door is flush with the front surface of the panel to a second position where the outer face extends parallel to the front surface and the door is positioned behind the front surface.

18 Claims, 4 Drawing Sheets

(51) Int. Cl.

| | |
|---|---|
| ***A61G 12/00*** | (2006.01) |
| ***E05D 13/00*** | (2006.01) |
| ***E05D 15/20*** | (2006.01) |
| ***A47B 81/00*** | (2006.01) |

(56) References Cited

U.S. PATENT DOCUMENTS

| | | | | | |
|---|---|---|---|---|---|
| 1,678,444 | A | | 7/1928 | Roedel | |
| 2,171,663 | A | | 9/1939 | Marchand | |
| 2,773,728 | A | | 12/1956 | Barre | |
| 2,992,460 | A | | 7/1961 | Hentges | |
| 3,101,135 | A | * | 8/1963 | Neal et al. | 49/248 |
| 3,345,775 | A | | 10/1967 | Crosby | |
| 3,417,509 | A | | 12/1968 | Sherron | |
| 3,484,993 | A | * | 12/1969 | Gerhard et al. | 49/216 |
| 3,585,757 | A | * | 6/1971 | Ritchie et al. | 49/215 |
| 3,802,125 | A | | 4/1974 | Baker | |
| 4,338,485 | A | | 7/1982 | Fullenkamp et al. | |
| 4,561,211 | A | | 12/1985 | Raley et al. | |
| 4,575,967 | A | | 3/1986 | Bickerstaff | |
| 4,646,211 | A | | 2/1987 | Gallant et al. | |
| 4,753,055 | A | | 6/1988 | Durham, Jr. | |
| 4,771,575 | A | | 9/1988 | Tiesler | |
| 4,821,470 | A | | 4/1989 | Kappers et al. | |
| 5,050,943 | A | | 9/1991 | Barnett | |
| 5,060,425 | A | | 10/1991 | Kappers et al. | |
| 5,064,147 | A | | 11/1991 | Noble et al. | |
| 5,086,586 | A | | 2/1992 | Hlavaty et al. | |
| 5,099,611 | A | | 3/1992 | Kracht et al. | |
| 5,108,165 | A | | 4/1992 | Rorke et al. | |
| 5,323,565 | A | | 6/1994 | Kappers et al. | |
| 5,448,859 | A | | 9/1995 | Walker et al. | |
| 5,542,214 | A | | 8/1996 | Buening | |
| 5,572,829 | A | * | 11/1996 | Stoltenberg | 49/200 |
| 5,653,064 | A | | 8/1997 | Kappers et al. | |
| 5,934,776 | A | | 8/1999 | Motta | |
| 6,481,156 | B1 | | 11/2002 | Richmond | |
| 6,497,072 | B2 | | 12/2002 | Fries | |
| 6,691,462 | B2 | | 2/2004 | Oestermann | |
| 6,691,463 | B1 | | 2/2004 | Richmond | |
| 6,742,564 | B2 | * | 6/2004 | Martin | 160/201 |
| 6,840,009 | B2 | | 1/2005 | Ronay et al. | |
| 6,860,311 | B1 | | 3/2005 | Minor | |
| 7,040,057 | B2 | | 5/2006 | Gallant et al. | |
| 7,174,678 | B2 | | 2/2007 | Gallant | |
| 7,219,472 | B2 | | 5/2007 | Gallant et al. | |
| 7,393,042 | B2 | | 7/2008 | Alfstad-Seibel et al. | |
| 7,448,703 | B2 | | 11/2008 | Kung | |
| 7,537,030 | B2 | | 5/2009 | Gallant | |
| 7,735,897 | B2 | | 6/2010 | Seiple et al. | |
| 7,775,000 | B2 | | 8/2010 | Walker et al. | |
| 8,006,440 | B2 | | 8/2011 | Thomas et al. | |
| 8,113,607 | B2 | | 2/2012 | Slager et al. | |
| 8,375,645 | B2 | * | 2/2013 | Iwauchi et al. | 52/29 |
| 2006/0225357 | A1 | | 10/2006 | Bortoluzzi | |
| 2008/0276551 | A1 | | 11/2008 | Thomas et al. | |
| 2010/0095604 | A1 | | 4/2010 | Newkirk et al. | |

FOREIGN PATENT DOCUMENTS

| | | | |
|---|---|---|---|
| GB | 1477843 | A | 6/1977 |
| JP | 05133157 | A | 5/1993 |
| JP | 10297848 | A | 11/1998 |
| JP | 2001261269 | A | 9/2001 |
| JP | 2010133221 | A | 6/2010 |
| WO | 84/01140 | A1 | 3/1984 |

* cited by examiner

VERTICAL CABINET DOOR WITH FLUSH FRONT FACE

This application is a continuation application that claims priority under 35 U.S.C. §120 to U.S. patent application Ser. No. 12/861,204, now U.S. Pat. No. 8,375,646, which was filed on Aug. 23, 2010 and is incorporated herein by reference.

BACKGROUND

The present disclosure relates headwalls for use in a healthcare facility. More particularly, the present disclosure relates to a headwall having a vertically sliding door to conceal devices for the delivery of medical care or other areas that may be used for storage.

Clinical care settings, such as a hospital room, for example, serve a two-fold purpose of delivering healthcare services. In the first instance, the hospital room serves as an area for delivery of medical care. In the second instance, the hospital room serves as a residence for a recuperating patient.

With regard to the delivery of medical care services, the hospital room must include state of the art technology accessible to the healthcare provider during the delivery of care. As the acuity of a patient's illness or injury increases, the complexity of additional equipment required to assist with the delivery of care increases. The vital signs of a patient are taken on a regular basis. In a critical care/intensive care unit, other monitoring equipment and service delivery equipment is required. For example, vital signs monitoring may be required in conjunction with ventilation equipment. Generally, the support for the equipment is positioned at the head end of the bed in an architectural headwall unit. For example, gases such as oxygen and compressed air may be delivered to the patient room. A vacuum line may also be provided. Electrical service outlets may also be provided with certain devices being connected to power circuits including emergency back-up for critical devices. The architectural headwall units may also provide central lighting controls and may be configured to provide support for healthcare equipment such as monitoring devices and fluid collection canisters.

The delivery of gases and power and the support of healthcare equipment tend to cause the headwall area of a patient room to appear more clinically oriented than residential. In order to provide a more aesthetically pleasing environment for recuperation, hospitals are known to utilize structures within the room constructed employing wood grains and configured with gas and electrical outlets.

SUMMARY

The present invention comprises an apparatus and/or method that has any one or more of the features listed in the appended claims and/or any one or more of the following features, which alone or in any combination may comprise patentable subject matter:

According to one aspect of the present disclosure, a headwall for a patient's room is disclosed. The headwall includes a panel having a vertically-extending front surface, an opening defined in the front surface of the headwall, and a door sized to be received in the opening. The door is vertically movable from a first position where an outer face of the door is flush with the front surface of the panel to a second position where the outer face extends parallel to the front surface and the door is positioned behind the front surface. In some embodiments, the door may be vertically movable to a third position vertically positioned between the first position and the second position and where the door may extend at an angle relative to the front surface of the headwall. In some embodiments, the door may be located above the opening when placed in the second position.

In some embodiments, the headwall may further include a first set of roller bearings coupled to an upper end of the door and a second set of roller bearings coupled to the door below the first set of roller bearings, and a first set of guide slots sized to receive the first set of roller bearings and a second set of guide slots sized to receive the second set of roller bearings. The second set of guide slots may be partially positioned behind the first set of guide slots. Additionally, in some embodiments, each guide slot of the first set of guide slots and each guide slot of the second set of guide slots may include a straight section positioned behind, and extending parallel to, the front surface of the headwall and a curved section. In some embodiments, the curved section of each guide slot of the second set of guide slots may be an S-shaped section.

In some embodiments, the door may include an upper surface extending at a non-orthogonal angle relative to the outer face of the door. In some embodiments, the headwall may include a counterbalance coupled to the door sized to maintain the door at each of the first position and the second position. In some embodiments, the counterbalance may be a constant force spring extending parallel to the front surface of the headwall.

In some embodiments, the headwall may further include a utility trunk having a passageway defined therein. The passageway may be inaccessible when the door is placed in the first position and accessible through the opening defined in the front surface of the headwall when the door is placed in the second position. In some embodiments, the door may be located within the passageway when placed in the second position.

According to another aspect, a headwall for a patient's room is disclosed. The headwall includes a front panel having a vertically-extending surface having an opening defined therein, a cabinet secured to the front panel and having a storage chamber defined therein, and a door sized to be received in the opening. The door is movable between a first position where the storage chamber is inaccessible and an outer face of the door is flush with the vertically-extending surface and a second position where the storage chamber is accessible through the opening and the outer face of the door extends parallel to the vertically-extending surface. In some embodiments, the door may be located behind the front panel and above the opening when placed in the second position.

In some embodiments, the headwall may further include a first roller bearing coupled to an upper end of the door and a second roller bearing coupled to the door below the first roller bearing. A first guide slot may be defined in a first support and may be sized to receive the first roller bearing. A second guide slot may be defined in the first support and may be sized to receive the second roller bearing. The second guide slot may be partially positioned behind the first guide slot. Additionally, in some embodiments, the first guide slot and the second guide slot may include a straight section positioned behind the front panel and extending parallel to the vertically-extending surface and a curved section.

In some embodiments, the curved section of the second guide slot may be an S-shaped section. In some embodiments, the headwall may further include a constant force spring extending parallel to the vertically-extending surface of the front panel and coupled to the door. The constant force spring may be sized to counterbalance the door such that the door is maintained at each of the first position and the second position.

According to another aspect, a headwall for a patient's room includes a panel having a vertically-extending surface, a plurality of openings defined in the vertically-extending surface of the panel, and a plurality of doors. Each door is vertically movable from a first position where the door is received in the opening and an outer face of the door is flush with the vertically-extending surface of the panel to a second position where the door is positioned behind the panel and above the opening. In some embodiments, the headwall may further include a plurality of constant force springs extending parallel to the vertically-extending surface of the panel. Each constant force spring may be coupled to a separate door of the plurality of doors. The constant force spring may be sized to counterbalance the door such that the door is maintained at each of the first position and the second position.

In some embodiments, the outer face of each door may extend parallel to the vertically-extending surface of the panel when the door is placed in the second position. Additional features will become apparent to those skilled in the art upon consideration of the following detailed description of illustrative embodiments exemplifying the best mode as presently perceived.

BRIEF DESCRIPTION OF THE DRAWINGS

The detailed description particularly refers to the accompanying figures in which.

DETAILED DESCRIPTION OF THE DRAWINGS

Figure 1:
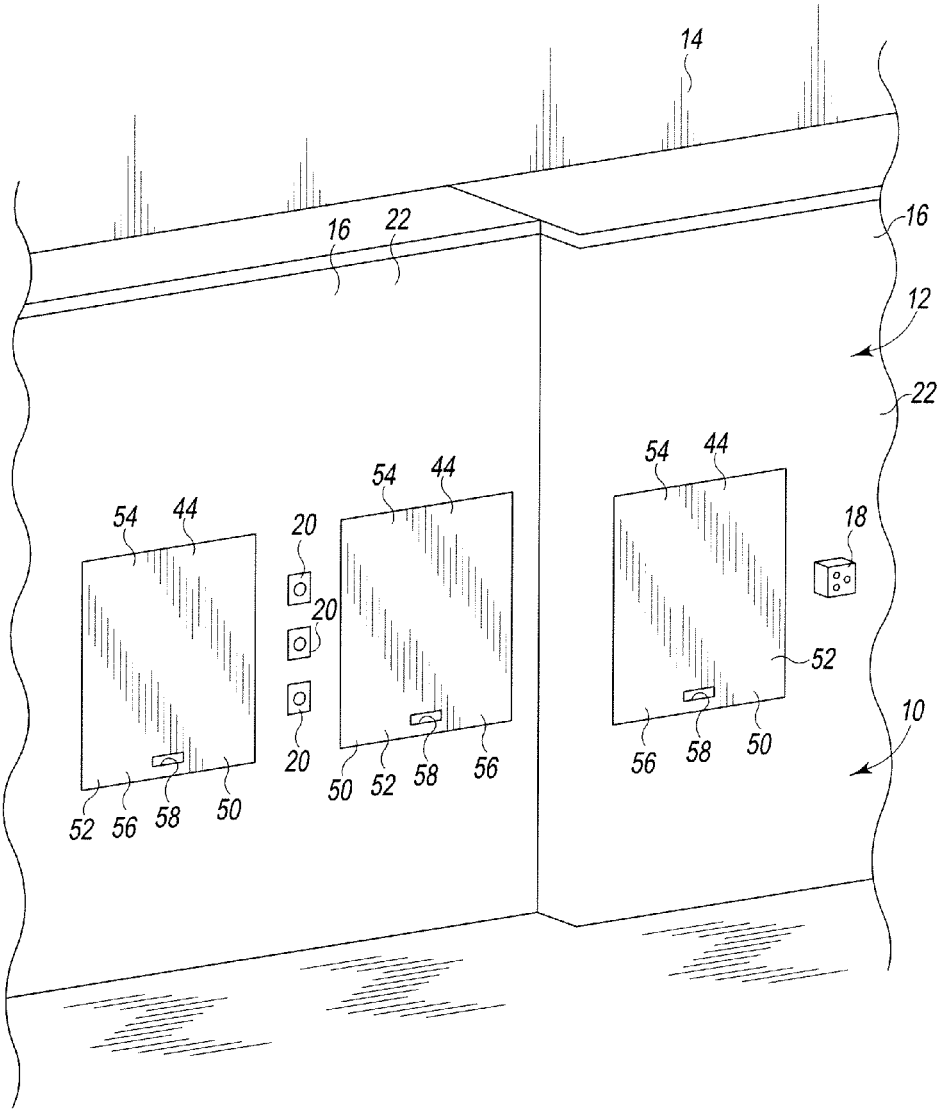
FIG. 1 is a perspective view of a patient room in a hospital showing a headwall including a number of doors of the present invention.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring to FIG. 1, a patient room 10 of a hospital or other medical care facility, such as a nursing home, is shown. A headwall 12 is shown positioned at a wall 14, but it should be appreciated that in other embodiments the headwall 12 may be positioned at any of the walls of the room 10. Headwalls are sometimes referred to as headwall units, but are herein simply referred to as headwalls. The headwall 12 may be formed as a single unit or as a plurality of modular units. One example of a modular headwall is described in U.S. Patent Application Publication No. 2010/0095604 entitled "Modular Architectural Room System," which is expressly incorporated herein by reference.

The headwall 12 includes a plurality of panels 16 that conceal gas pressure lines, vacuum hoses, electrical wiring, storage chambers, and other support for utilities positioned behind the headwall 12. A nurse-call unit 18, a plurality of outlets 20, and other equipment are shown mounted to the headwall 12 in the illustrative example, but these are simply optional components and may not be present in other embodiments. Furthermore, other types of equipment may be mounted to, or included in, headwall 12 as is known in the art. As shown in FIG. 1, each of the panels 16 defines a vertically-extending front surface 22. It will be appreciated that in other embodiments the headwall 12 may include additional panels, which are placed adjacent to each other to define the front surfaces 22.

Figure 2:
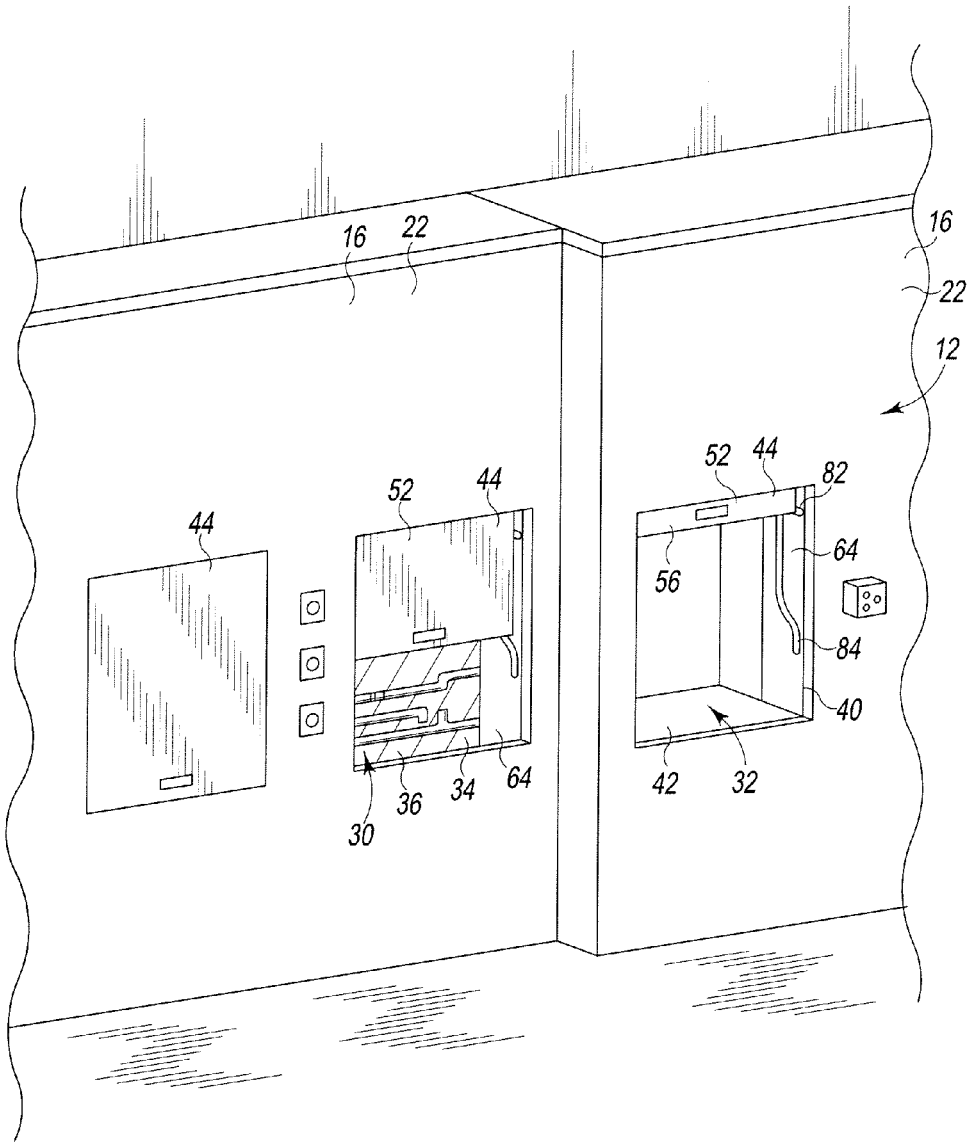
FIG. 2 is a perspective view of a patient room in a hospital showing the doors of the FIG. 1 in various positions.

As shown in FIG. 2, the headwall 12 includes a utility trunk 30 and a cabinet 32 secured to the panel 16. The utility trunk 30 defines a passageway 34 that extends between the headwall 12 and the wall 14. The passageway 34 includes an opening 36 formed in the front surface 22 of one of the panels 16. The opening 36 permits the patient, caregiver, or other individuals to access the gas pressure lines, vacuum hoses, electrical wiring, and other support for utilities positioned within the passageway 34. Similarly, the cabinet 32 defines a storage chamber 40 and includes an opening 42 formed in the front surface 22 of one of the panels 16. The opening 42 permits the patient, caregiver, or other individuals to access the storage chamber 40. It will be appreciated that in other embodiments the headwall may include additional utility trunks, cabinets, and other storage areas.

A door 44 is associated with each of the openings 36, 42 and is vertically movable between an open position and a closed position. As shown in FIGS. 1 and 2, the passageway 34 is inaccessible through the opening 36 when the door 44 is in a closed position (see FIG. 1) and is accessible when, for example, the door 44 is in an open position (see FIG. 2). Similarly, the storage chamber 40 is inaccessible through the opening 42 when another door 44 is in a closed position (see FIG. 1) and is accessible when the door 44 is in an open position (see FIG. 2).

Each door 44 includes a rigid body 50 having an outer face 52 extending from an upper end 54 to a lower end 56. The door 44 includes a handle 58 that may be used to open and close the door 44. When the door 44 is closed, the outer face 52 is flush with the vertically-extending front surface 22 of the panel 16. The term "flush" is defined herein as forming a single continuous plane. This is distinguishable from, and, in contrast to, having one surface recessed behind or below another surface because the recessed surface does not form a single continuous plane with the non-recessed surface. As shown in FIG. 1, the outer face 52 of the door 44 and the front surface 22 of the panel 16 form a single continuous plane when the door 44 is closed. When the door 44 is moved to an open position, the door 44 is positioned behind the panel 16, as shown in FIG. 2.

Figure 3:
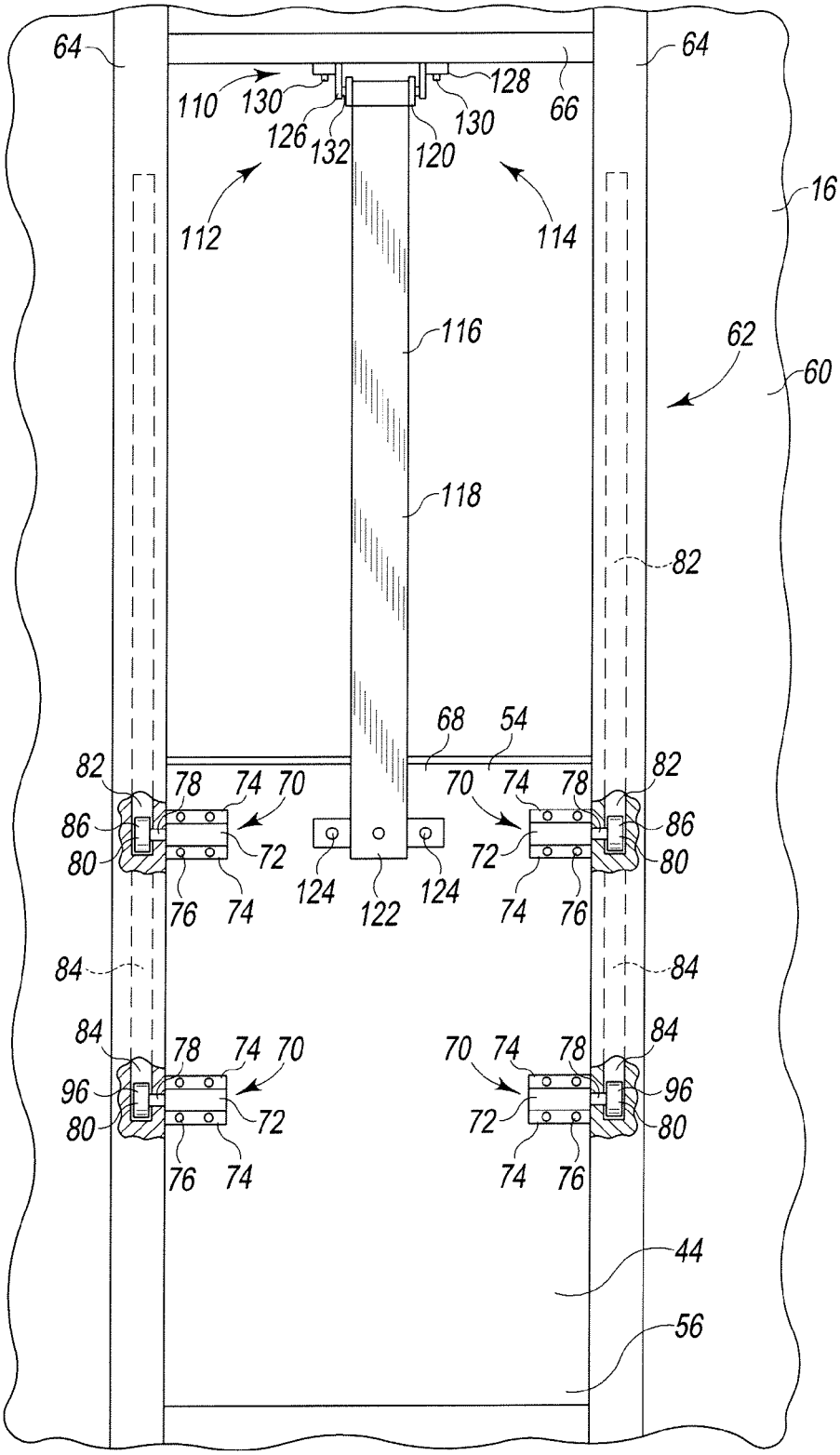
FIG. 3 is a rear elevation cutaway view of back side of the headwall of FIG. 1.

Referring now to FIG. 3, the back side 60 of the headwall 12 is shown with one of the doors 44 placed in the closed position. The headwall 12 includes a frame 62 having a pair of support columns 64 supporting a header 66. The door 44 is positioned between the support columns 64, and the rear face 68 of the door 44 has a plurality of roller mounts 70 secured thereto. Each roller mount 70 includes a body 72 having a pair of flanges 74 extending outwardly therefrom. Each flange 74 has a number of fasteners 76 extending therethrough to secure the roller mount 70 to the rear face 68 of the door 44. Each roller mount 70 also includes a pin 78 extending outwardly from the body 72. A roller bearing 80 is mounted to each pin 78 and is configured to rotate about a horizontal axis.

Figure 4:
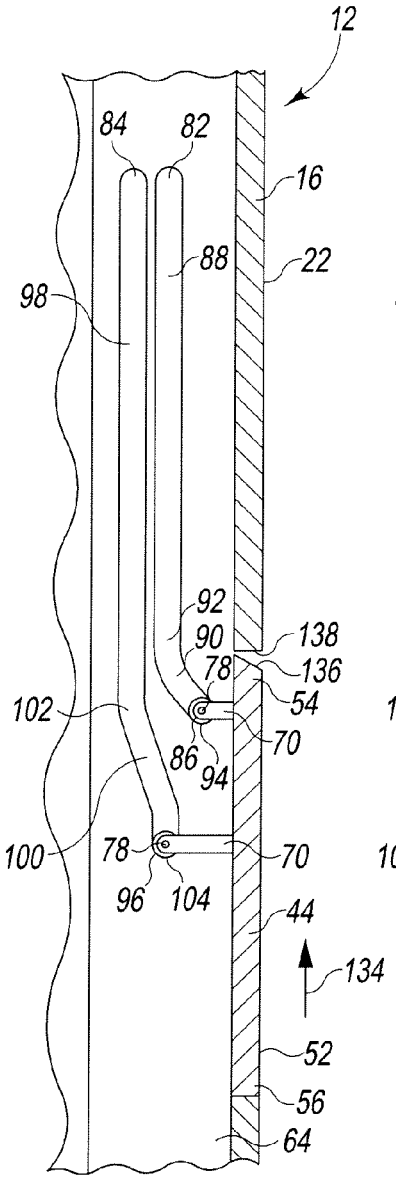
FIG. 4 is a cross-sectional side elevation view of the headwall of FIG. 1 showing one of the doors in a closed position.

As shown in FIGS. 3-6, each support column 64 includes a pair of guide slots 82, 84, and each roller bearing 80 is received in a corresponding one of the slots 82, 84. It should be appreciated that the guide slots 82, 84 formed in one column 64 are mirror images of the guide slots 82, 84 formed in the other column 64. As best seen in FIGS. 46, a roller bearing 86 is secured to the door 44 at the upper end 54 and is received in one of the slots 82 formed in the column 64. Each slot 82 includes a substantially-straight upper section 88 and a curved lower section 90. The upper section 88 is positioned behind the panel 16 and extends parallel to the front surface 22 of the panel 16, as shown in FIG. 4. The lower section 90 of the slot 82 is connected to the upper section 88 at an upper end 92 and extends downwardly to a lower end 94. When the door 44 is fully closed, the roller bearing 86 is positioned at the lower end 94 of the slot 82.

Figure 5:
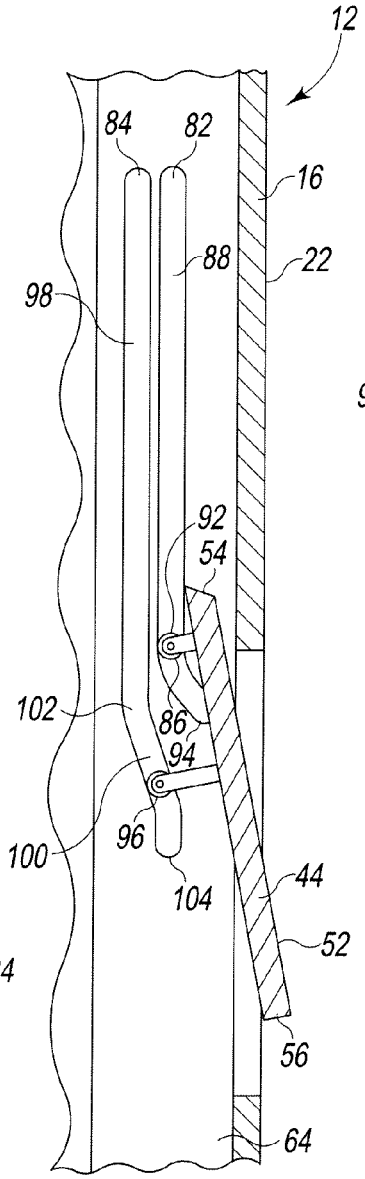
FIG. 5 is a cross-sectional side elevation view of the headwall of FIG. 1 showing one of the doors in partially opened position.
Figure 6:
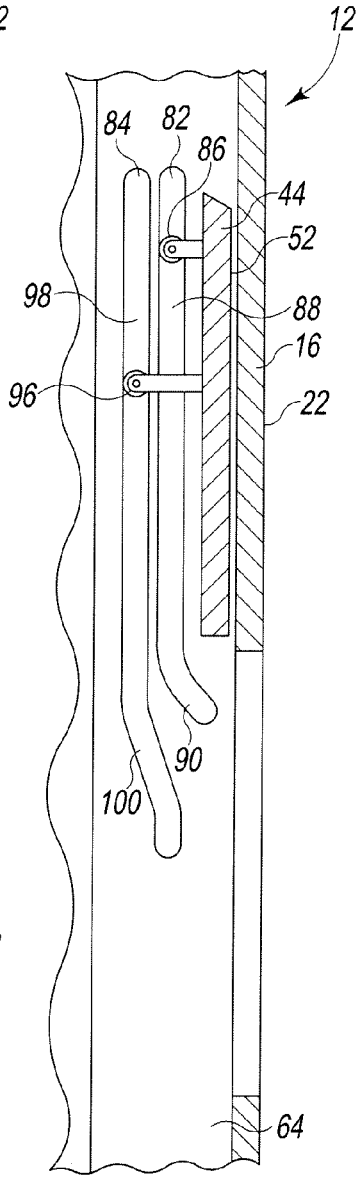
FIG. 6 is a cross-sectional side elevation view of the headwall of FIG. 1 showing one of the doors in a fully opened positioned.

A roller bearing 96 is secured to the door 44 below the roller bearing 86 and is received in one of the slots 84. As best seen in FIG. 4, the roller bearing 86 is positioned closer to the rear face 68 of the door 44 than the roller bearing 96. Similar to each slot 82, each slot 84 includes a substantially-straight upper section 98 and a curved lower section 100. The upper section 98 of the slot 84 is positioned behind the panel 16 and the upper section 88 of the slot 82. As best seen in FIG. 4, the upper section 98 of the slot 84 also extends parallel to the front surface 22 of the panel 16. The lower section 100 of the slot 84 is connected to the upper section 98 at an upper end 102 and extends downwardly to a lower end 104. As shown in FIGS. 4-6, the lower section 100 of the slot 84 follows an S-shaped path from the upper end 102 to the lower end 104. When the door 44 is fully closed, the roller bearing 96 is positioned at the lower end 104 of the slot 84. As will be described in greater detail below, the roller bearings 86, 96 are advanced along the guide slots 82, 84 as the door 44 is moved between the open and closed positions.

Returning to FIG. 2, the headwall 12 includes a counterbalancing device 110 sized to maintain the door 44 at any position relative to the opening 42. In that way, the door 44 may be maintained at any position, without drifting up or down, until the patient, caregiver, or other individual applies an external force to the handle 58. In the illustrative embodiment, the counterbalancing device 110 is a spring mechanism 112. In other embodiments, the counterbalancing device 110 may be a system of counterweights and pulleys configured to balance the weight of the door 44 at any position until an external force is applied.

The spring mechanism 112 includes a base 114 and a constant force spring 116 that is sized to counterbalance the weight of the door 44 at any position. One example of a constant force spring is the Conforce® Constant Force Spring, which is commercially available from Vulcan Spring & Mfg. Co. of Telford, Pa. The spring 116 includes a body 118 that is coupled at one end (not shown) to a spool 120 mounted on the base 114. The other end 122 of the spring 116 is secured to the upper end 54 of the door 44 via a number of fasteners 124. When the door 44 is closed, the body 118 of the spring 116 extends parallel to the surface 22 of the panel 16.

The base 114 of the spring mechanism 112 has a pair of mounting legs 126, 128. The mounting legs 126, 128 are secured to the header 66 via a number of fasteners 130. The base 114 also includes a cylindrical bar 132 extending from one mounting leg 126 to the other mounting leg 128. The spool 120 is positioned over the bar 132 and is configured to rotate about a horizontal axis. As the door 44 is moved from the closed position to the open position, the spool 120 is rotated and the body 118 of the spring 116 is wound around the spool 120 as the door 44 is moved toward the header 66. When the door is moved from the open position to the closed position, the body 118 of the spring 116 unwinds from the spool 120.

The path of the door 44 as the door 44 is moved from the closed position to the open position is best seen in FIGS. 46. When the door 44 is closed, as shown in FIG. 4, the outer face 52 of the door 44 is flush with the vertically-extending front surface 22 of the panel 16. As described above, each of roller bearings 86, 96 are positioned at the lower ends 94, 104 of their respective slots 82, 84. When an external force is applied in the direction indicated by arrow 134, the door 44 is moved upward and the roller bearings 86, 96 are advanced along their respective slots 82, 84.

As the door 44 is moved upward, the varying curvature of the lower sections 90, 100 causes the lower end 56 of the door 44 to pitch outward and the upper end 54 of the door 44 is pitched inward. In illustrative embodiment, the upper surface 136 of the door 44 extends at a non-orthogonal angle relative to the outer face 52 of the door 44, thereby ensuring that the upper end 54 of the door 44 avoids contact with a lower edge 138 of the panel 16. As shown in FIG. 5, the door 44 may be moved to an intermediate position between the fully open and fully closed position. In that intermediate position, the roller bearing 86 is positioned at the upper end 92 of the lower section 90 of the slot 82, and the outer face 52 of the door 44 is angled relative to the front surface 22 of the panel 16.

When the door 44 is moved upward beyond the intermediate position, the pitch of the door 44 changes such that the outer face 52 is not angled relative to the front surface 22. As shown in FIG. 6, when the roller bearings 86, 96 are positioned in the upper sections 88, 98 of the slots 82, 84, the outer face 52 extends parallel to the front surface 22. In the fully open position shown in FIG. 6, the door 44 is positioned behind the panel 16 in the passageway 34 or the storage chamber 40 of the headwall 12. The door 44 is also located above the opening 42 such that the patient, caregiver, or any other individual is permitted to access to the passageway 34 or the storage chamber 40.

As will be appreciated by those of the skill in the art, the headwall 12 may include elements other than those shown and described above. In another embodiment, the headwall 12 may have two or more counterbalancing devices 110 per door 44. For example, each door 44 may include two constant force springs 116 sized to balance the weight of the door 44 at any position until an external force. It will also be appreciated that the counterbalancing device 110 may take other forms and may be embodied as an electric linear actuator that will raise or lower the door 44. The linear actuator may be controlled by the user through the use of a push button mounted to the panel 16 adjacent to the corresponding door 44.

Although certain illustrative embodiments have been described in detail above, variations and modifications exist within the scope and spirit of this disclosure as described and as defined in the following claims.

The invention claimed is:

1. A storage unit comprising a panel having a vertically-extending front surface, an opening defined in the front surface of the storage unit, a door sized to be received in the opening, a first set of roller bearings coupled to an upper end of the door and a second set of roller bearings coupled to the door below the first set of roller bearings, and a first set of guide slots sized to receive the first set of roller bearings and a second set of guide slots sized to receive the second set of roller bearings, the second set of guide slots being partially positioned behind the first set of guide slots, wherein the door is vertically movable from (i) a first position where an outer face of the door is flush with the front surface of the panel to (ii) a second position where the outer face extends parallel to the front surface and the door is positioned behind the front surface.

2. The storage unit of claim 1, wherein the door is vertically movable to a third position vertically positioned between the first position and the second position and where the door extends at an angle relative to the front surface of the storage unit.

3. The storage unit of claim 2, wherein the door is located above the opening when placed in the second position.

4. The storage unit of claim 1, wherein each guide slot of the first set of guide slots and each guide slot of the second set of guide slots includes (i) a straight section positioned behind, and extending parallel to, the front surface of the storage unit and (ii) a curved section.

5. The storage unit of claim 4, wherein the curved section of each guide slot of the second set of guide slots is an S-shaped section.

6. The storage unit of claim 1, wherein the door includes an upper surface extending at a non-orthogonal angle relative to the outer face of the door.

7. The storage unit of claim 1, further comprising a counterbalance coupled to the door sized to maintain the door at each of the first position and the second position.

8. The storage unit of claim 7, wherein the counterbalance is a constant force spring extending parallel to the front surface of the storage unit.

9. The storage unit of claim 1, further comprising a utility trunk having a passageway defined therein, the passageway being (i) inaccessible when the door is placed in the first position and (ii) accessible through the opening defined in the front surface of the storage unit when the door is placed in the second position.

10. The storage unit of claim 9, wherein the door is located within the passageway when placed in the second position.

11. A storage unit for a patient's room comprising a front panel including a vertically-extending surface having an opening defined therein, a cabinet secured to the front panel and having a storage chamber defined therein, and a door sized to be received in the opening, and a constant force spring extending parallel to the vertically-extending surface of the front panel and coupled to the door, wherein the door is movable between (i) a first position where the storage chamber is inaccessible and an outer face of the door is flush with the vertically-extending surface and (ii) a second position where the storage chamber is accessible through the opening and the outer face of the door extends parallel to the vertically-extending surface, and wherein the constant force spring is sized to counterbalance the door such that the door is maintained at each of the first position and the second position.

12. The storage unit of claim 11, wherein the door is located behind the front panel and above the opening when placed in the second position.

13. The storage unit of claim 11, further comprising a first roller bearing coupled to an upper end of the door, a second roller bearing coupled to the door below the first roller bearing, a first guide slot defined in a first support sized to receive the first roller bearing, and a second guide slot defined in the first support sized to receive the second roller bearing, the second guide slot being partially positioned behind the first guide slot.

14. The storage unit of claim 13, wherein the first guide slot and the second guide slot includes (i) a straight section positioned behind the front panel and extending parallel to the vertically-extending surface and (ii) a curved section.

15. The storage unit of claim 14, wherein the curved section of the second guide slot is an S-shaped section.

16. A storage unit for a patient's room comprising a panel including a vertically-extending surface, a plurality of openings defined in the vertically-extending surface of the panel, a plurality of doors, a first set of roller bearings coupled to an upper end of each door and a second set of roller bearings coupled to each door below the first set of roller bearings, and a first set of guide slots sized to receive each first set of roller bearings and a second set of guide slots sized to receive each second set of roller bearings, each second set of guide slots being partially positioned behind each first set of guide slots, each door being vertically movable from (i) a first position where the door is received in one opening and an outer face of the door is flush with the vertically-extending surface of the panel to (ii) a second position where the door is positioned behind the panel and above the one opening, wherein the outer face of each door extends parallel to the vertically-extending surface of the panel when the door is placed in the second position.

17. The storage unit of claim 16, wherein further comprising a plurality of constant force springs extending parallel to the vertically-extending surface of the panel, each constant force spring being coupled to a separate door of the plurality of doors, the constant force spring being sized to counterbalance the door such that the door is maintained at each of the first position and the second position.

18. The storage unit of claim 16, wherein the storage unit is a headwall for a patient's room.

* * * * *

UNITED STATES PATENT AND TRADEMARK OFFICE

CERTIFICATE OF CORRECTION

PATENT NO. : 8,955,260 B2
APPLICATION NO. : 13/686465
DATED : February 17, 2015
INVENTOR(S) : David C. Newkirk et al.

It is certified that error appears in the above-identified patent and that said Letters Patent is hereby corrected as shown below:

Title Page, item [75]

The spelling of the inventor's name, "Charles R. Belser", should be corrected to --Charles R. Beiser--.

Signed and Sealed this
Twenty-first Day of July, 2015

Michelle K. Lee

Michelle K. Lee
*Director of the United States Patent and Trademark Office*